US005678279A

United States Patent [19]

Gühne et al.

[11] Patent Number: 5,678,279

[45] Date of Patent: Oct. 21, 1997

[54] FLOOR CARE APPLIANCE, IN PARTICULAR VACUUM CLEANING APPLIANCE, HAVING DOWNWARDLY DIRECTED BRISTLES PREFERABLY DISPOSED ABOUT THE OUTER PERIPHERAL EDGE

[75] Inventors: Wieland Gühne, Remscheid, Germany; Gentile Marafante, Carnate Milano; Mario Tecchiati, Villa Raverio Milano, both of Italy; Thomas Braun, Sprockhövel, Germany

[73] Assignee: Vorwerk & Co. Interholding GmbH, Wuppertal, Germany

[21] Appl. No.: 481,382

[22] PCT Filed: Nov. 25, 1994

[86] PCT No.: PCT/EP94/03898

§ 371 Date: Jul. 21, 1995

§ 102(e) Date: Jul. 21, 1995

[87] PCT Pub. No.: WO95/14421

PCT Pub. Date: Jun. 1, 1995

[30] Foreign Application Priority Data

Nov. 26, 1993 [DE] Germany ..... 9318141 U

[51] Int. Cl.[6] ..... A47L 9/06

[52] U.S. Cl. ..... 15/371; 15/42; 15/49.1; 15/201; 15/398; 15/365

[58] Field of Search ..... 15/398, 400, 365, 15/371, 373, 42

[56] References Cited

U.S. PATENT DOCUMENTS

| | | | |
|---|---|---|---|
| 2,616,118 | 11/1952 | Meyerhoefer | 15/371 X |
| 2,703,903 | 3/1955 | Faith-Ell | 15/365 |
| 2,897,824 | 10/1959 | Coons | 15/371 X |
| 2,932,055 | 4/1960 | Kemper . | |
| 2,966,693 | 1/1961 | Anderson | 15/373 |
| 3,832,753 | 9/1974 | Crooks | 15/371 |
| 4,244,080 | 1/1981 | Wessel . | |
| 4,720,891 | 1/1988 | Rennecker et al. | 15/371 |

FOREIGN PATENT DOCUMENTS

| | | | |
|---|---|---|---|
| 0264625 | 4/1988 | European Pat. Off. . | |
| 873285 | 7/1942 | France . | |
| 1074047 | 3/1954 | France | 15/373 |
| 2646567 | 4/1978 | Germany . | |
| 3112401 | 10/1982 | Germany . | |

*Primary Examiner*—Chris K. Moore
*Attorney, Agent, or Firm*—Martin A. Farber

[57] ABSTRACT

A floor care appliance, in particular a vacuum cleaning appliance, for example a vacuum cleaner (1) or a floor polisher, with downwardly directed bristles (11) arranged preferably around its outer periphery, the bristles (11) being fixed in a mounting strip (13), and the mounting strip (13) being positively held in a downwardly open receiving groove portion (14) of sidewalls (16, 19) inwardly extending projections (17, 24) being disposed on the sidewalls (16, 19). In order to enable force-free installation and removal of the mounting strip fitted with the bristles, the projections (24) of one sidewall (19) are displaceable into a release disposition for the mounting strip (13).

8 Claims, 7 Drawing Sheets

FLOOR CARE APPLIANCE, IN PARTICULAR VACUUM CLEANING APPLIANCE, HAVING DOWNWARDLY DIRECTED BRISTLES PREFERABLY DISPOSED ABOUT THE OUTER PERIPHERAL EDGE

FIELD AND BACKGROUND OF THE INVENTION

The invention relates to a floor care appliance, in particular a vacuum cleaning appliance, for example a vacuum cleaner or a floor polisher, having downwardly directed bristles disposed preferably at its outer periphery, the bristles being secured in a mounting or holding strip and the mounting strip being held in a positive manner enclosed in a downwardly opening receiving groove portion of the appliance, which receiving groove portion has sidewalls, inwardly extending projections being disposed on the sidewalls.

Floor care appliances, in particular vacuum cleaning appliances of the kind mentioned initially having downwardly directed bristles, are known. In this connection, constructions are preferred in which the bristles are secured in a holding strip, which is held in a downwardly opening receiving groove portion of the appliance by means of projections moulded on the sidewalls of the receiving groove portion and formed as rear cut-outs. There results because of this construction, a difficult mounting and demounting procedure for the bristle-holding strip, which is especially demanding of force. In this regard, the spring force of the receiving groove portion which is preferably made of plastics must in each case be overcome in the region of its projections. Factory assembly of the holding strip in the receiving groove portion is therefore made difficult. Also, a subsequent removal of the holding strip, for example for the purpose of exchanging bristles which have become worn out by use, proves to be especially demanding of force, since here also the holding strip must be taken out of the retaining groove portion by overcoming the spring force of the projections. In a further known embodiment, it is provided that the receiving groove portion is furnished with stops or abutments disposed on its sidewall, an open formation of the receiving groove portion being provided for mounting the bristle-holding strip. This open moulding is realised in such a manner that the base region of the receiving groove portion is formed open, so that the bristle-holding strip may be introduced from above into the receiving groove portion, which holding strip is then supported on the stops or abutments. The leakages resulting from the open formation in the region of the receiving groove portion, in particular the additional air resulting from this, represent significant disadvantages.

SUMMARY OF THE INVENTION

It is an object of the present invention to provide a floor care appliance of the kind in question, in particular a vacuum cleaning appliance with downwardly directed bristles disposed preferably at its outer periphery, which is constructed in a manner such that mounting and demounting of the holding strip provided with the bristles is facilitated in a manner not requiring force.

By the construction of the invention, there is provided a floor care appliance, in particular a vacuum cleaning appliance with downwardly directed bristles disposed preferably at its outer periphery, which bristles with their holding strip may be mounted in the receiving groove portion without the exercise of force.

Also, a correspondingly force-free demounting of the holding strip fitted with the bristles is possible by virtue of this construction. This is achieved in that the projections of one sidewall are movable into a release disposition for the holding strip. For mounting the bristles secured in the holding strip, this holding strip is inserted in the receiving groove portion of the appliance. Subsequently, the projections of one sidewall of the receiving groove portion may be moved from a release disposition for the holding strip into a retaining disposition. The holding or mounting strip provided with the bristles may now be supported on these projections and is thus secured in the receiving groove portion. This operational displaceability of the projections is provided by the construction of the appliance, the projections being here for example being able to be displaceable at right-angles to the run or direction of the receiving groove. The demounting of the holding strip is achieved in the most simple manner, in that the projections are moved correspondingly into a position in which the holding strip is released. Different embodiments of the projections are to be envisaged. In one embodiment, it may be provided that the displaceable projections penetrate the region of the bristles in their retaining disposition, so that the holding strip in an operating position of the floor care appliance is supported on these projections. In this embodiment, free spaces are provided in the region of the bristles for better mounting, through which free spaces the projections may penetrate. In a further embodiment, it is also to be envisaged that the displaceable projections are formed shorter in regard to their length, further projections on the other sidewall of the receiving groove portion being associated with these projections in their retaining disposition. The holding strip is in this connection supported in the operating disposition on its edge on one side on the displaceable projections and on the other side on the fixed projections. Independently of the embodiment of the displaceable projections, a floor care appliance is provided which is equipped with downwardly directed bristles, which appliance has advantages especially in the mounting and demounting of the holding strip fitted with the bristles. In an advantageous further embodiment, it is envisaged that the projections of the one side are formed on a retaining flange which is hinged onto the receiving groove portion. In order to define a retaining disposition for the holding strip, the projections of the one side move by means of the retaining flap in a direction towards the bristles of the holding strip. In this connection, there is preferably an embodiment in which the retaining flap is disposed on the receiving groove portion by means of a film hinge. By means of pivoting of the retaining flaps provided with the projections about a pivot axis defined in the region of the film hinge, the retaining or release disposition for the holding strip is achieved. By virtue of this construction, the receiving groove portion and the retaining flap may be connected together in a unitary manner in regard to material, in particular by manufacture of the receiving groove portion by means of the plastics injection moulding process. Furthermore, it is also provided that a retaining flap forms in each case a portion of the sidewall of the groove. The retaining flap is in this connection matched to the shape of the sidewall of the retaining groove portion associated with it, so that in the retaining disposition for the holding strip, the retaining flap matches the run or extent of the sidewall associated with it. In order to achieve a construction which is more favourable to mounting, it is provided that the receiving groove portion is disposed in a receiving pocket portion in the main frame. The holding strip equipped with the bristles is, as already described, inserted into the receiving groove portion and secured by means of the projections of the retaining flaps which are pivotable into the region of the bristles. Subsequently, the receiving groove portion with the holding strip is inserted as a component group in the receiving pocket portion of the main frame. This offers in particular the advantage that in mounting the bristle-holding strip, it is only necessary to manipulate the receiving groove portion, and not the entire floor care appliance, in particular a vacuum cleaning appliance. In an advantageous further embodiment, it is in this connection provided that in the course of an insertion of the receiving groove portion into the receiving pocket portion, a constrained controlled displacement of the retaining projections of one sidewall may be carried out into a retaining position for the holding strip. The holding strip may be inserted into the receiving groove portion in the most simple manner, after which the receiving groove portion is introduced into the receiving pocket portion. In this connection, the projections of the retaining flaps lying in the release disposition are moved in constrained controlled manner into the retaining disposition for the holding strip. By this, a procedural step is saved, namely the movement of the retaining flap into a retaining disposition for the holding strip. The insertion of the receiving groove portion into the receiving pocket portion effects gripping of the holding strip in the receiving groove portion. In this connection, it may be envisaged for the retaining flap to be formed to be resilient in such a manner that the retaining flap is always urged into a release disposition for the holding strip. This would be above all of particular advantage in a demounting operation, since in this case after removal of the receiving groove portion from the receiving pocket portion in the main frame, the retaining flaps of the receiving groove portion move into a release disposition for the holding strip, so that this latter may be taken out without exercise of force and optionally exchanged. On insertion of the receiving groove portion provided with the bristle holding strip into the receiving pocket portion in the main frame, the resilient retaining flaps are moved against their spring effect in a constrained controlled manner into the retaining disposition. In this connection, it may be further provided that guide means are provided on an outer surface of the retaining flap and/or on an inner surface of the receiving groove pocket portion. These guide means assist the constrained controlled displacement of the retaining projections provided on the retaining flaps into the retaining disposition for the holding strip. Finally, it is of still further advantage for the retaining flap to be lockable in its retaining disposition. This may for example be achieved by engagement of locking projections provided on the retaining flap behind corresponding recesses of the sidewall sections directed towards these retaining flaps.

BRIEF DESCRIPTION OF THE DRAWINGS

With the above and other advantages in view, the present invention will become more clearly understood in connection with the detailed description of preferred embodiments, when considered with the accompanied drawings, of which.

DETAILED DESCRIPTION OF THE PREFERRED EMBODIMENTS

Figure 1:
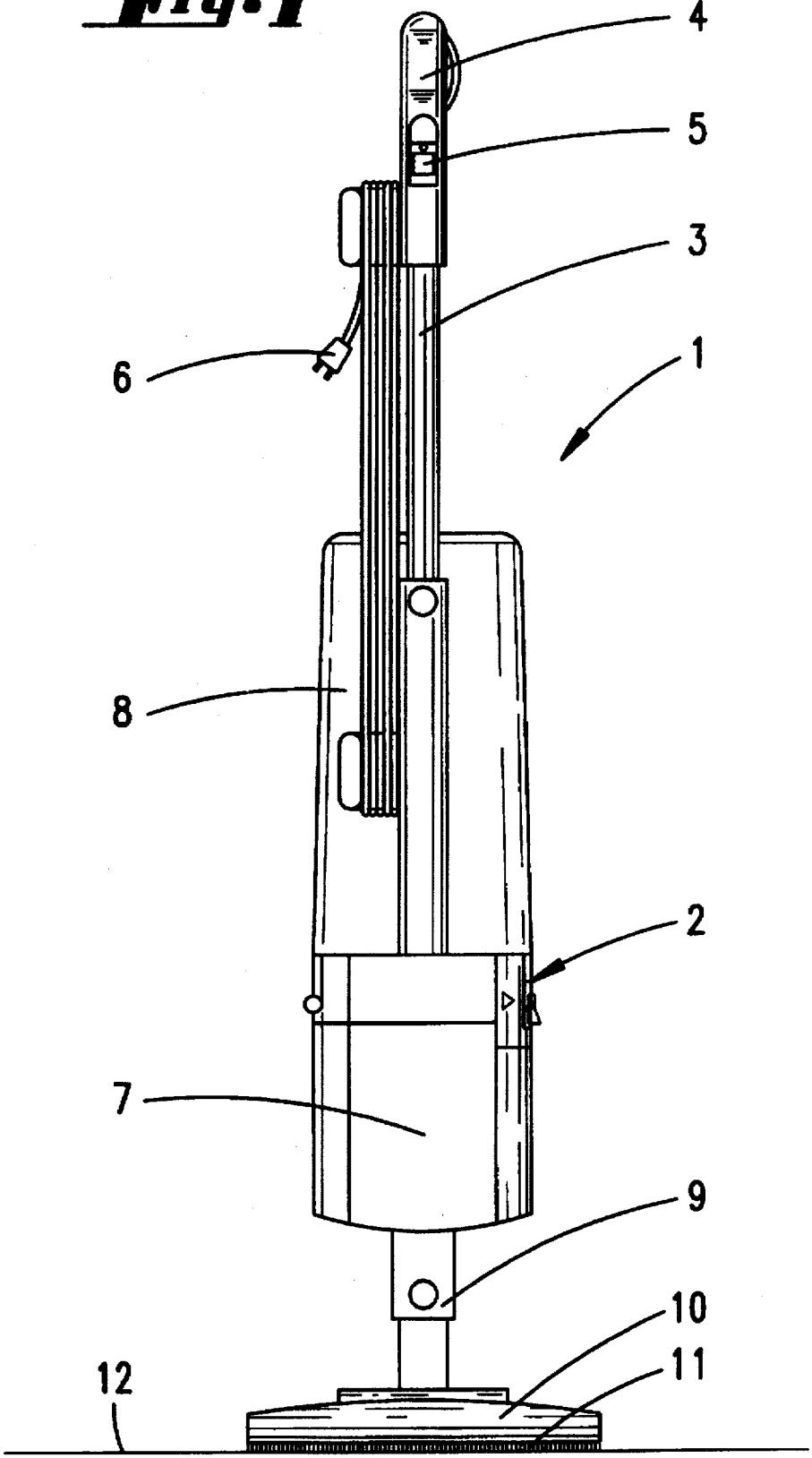
FIG. 1 is a front view of a floor care appliance according to the invention in the form of an electrical vacuum cleaning appliance having downwardly directed bristles disposed around the outer edge.

The electrical vacuum cleaner 1 shown is realised as a hand appliance. It has a housing 2, to which there is connected from above a handle 3, the handle 3 having a gripping portion 4 at its end. In the transition region between gripping portion 4 and handle 3, there is an on and off switch 5. The connection for the electrical cable is indicated by the reference numeral 6.

The housing is divided into a motor housing 7 and a chamber 8 extending upwardly above the housing 7 for receiving a filter bag, not shown. The blower of the motor is likewise not shown in detail in the drawings.

The motor housing 7 changes on its underside into a tubular coupling 8, which forms the airflow connection to a suction nozzle 10.

The suction nozzle 10 has downwardly directed bristles 11 disposed around its outer edge. In the operating disposition of the electrical vacuum cleaner 1 according to FIG. 1, these bristles rest on the floor 12 to be vacuumed or serviced.

A mounting or holding strip 13 is shown in each of the three embodiments, in which mounting strip, the bristles 11 are held. This is achieved in the usual manner, in that the ends of the bristles 11 are engaged and clamped by the mounting or holding strip 13 which preferably consists of metal.

Figure 2:
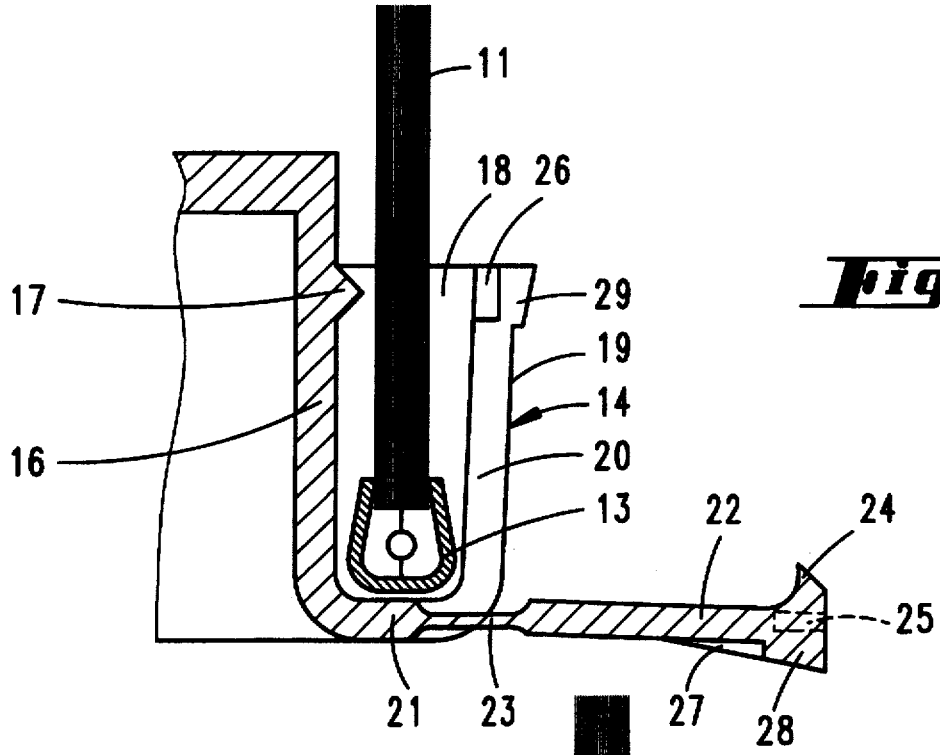
FIG. 2 shows a receiving groove portion associatable with a suction nozzle of the electrical vacuum cleaning appliance, in a mounting position, with a holding or mounting strip provided with bristles inserted, the drawing relating to a first embodiment.
Figure 3:
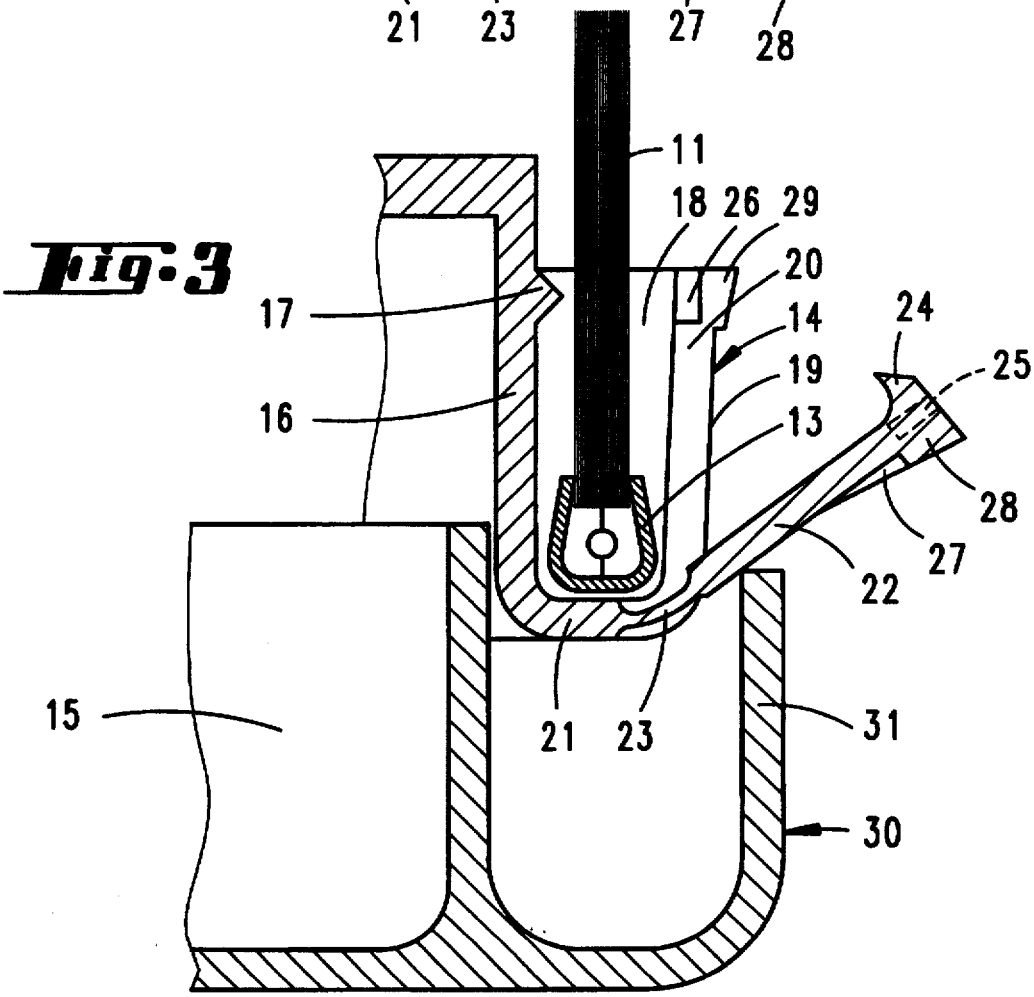
FIG. 3 is a representation following on FIG. 2, the receiving groove portion with enclosed mounting strip being introduced into a receiving pocket portion of the frame of the suction nozzle.
Figure 6:
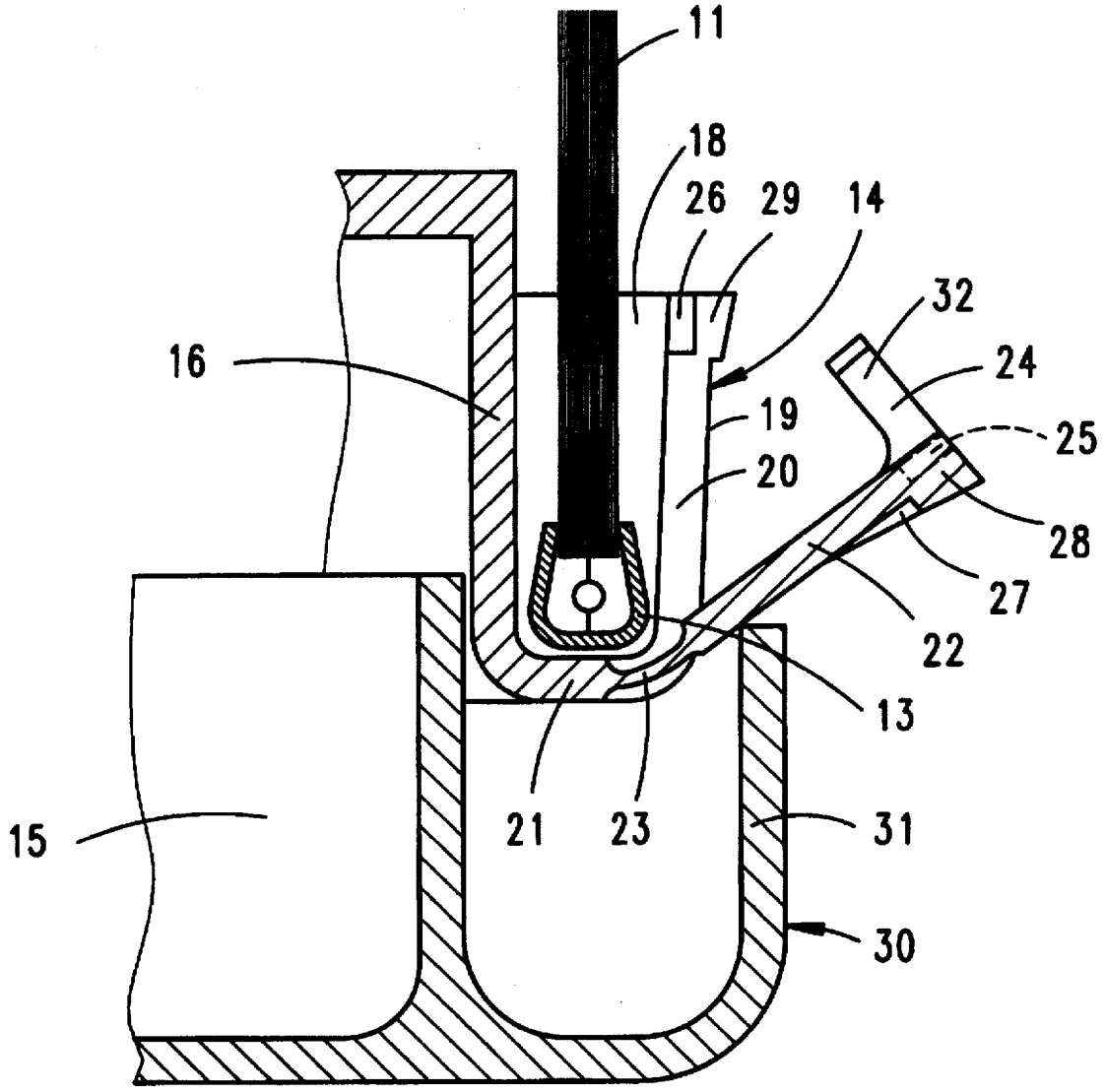
FIG. 6 is a representation corresponding to FIG. 3, but relating to a second embodiment.
Figure 9:
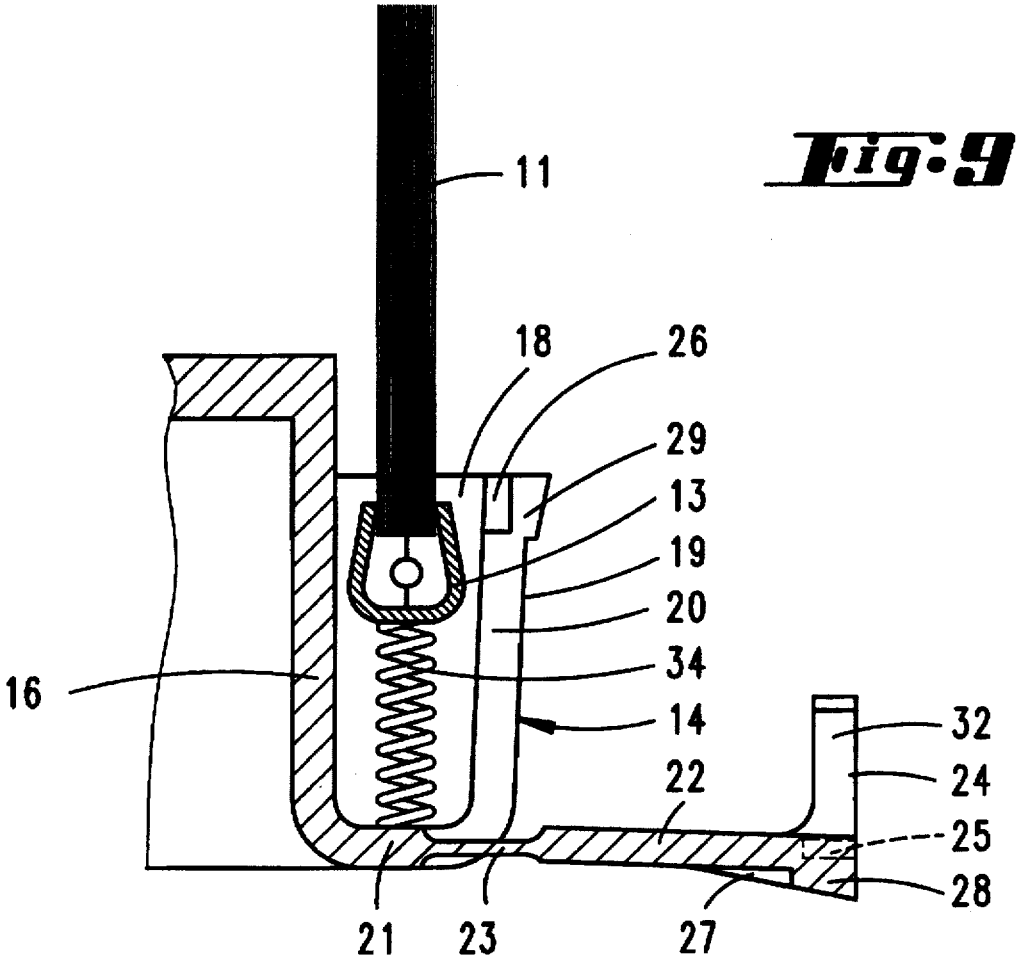
FIG. 9 is a representation corresponding to FIG. 2, relating to a third embodiment.

The holding strip 13 with the bristles 11 associated with it is introduced for mounting into a U-shaped receiving groove portion 14 which is downwardly open in the operating disposition according to FIG. 1 (see also FIGS. 2, 6 and 9).

The receiving groove portion 14 is formed as a frame which is insertable in the main frame 15 of the suction nozzle 10, the insertable frame being formed to have the same shape as the main frame 15.

In the first exemplary embodiment shown in FIGS. 2 to 5, a region of the receiving groove portion 14 on its inwardly disposed sidewall 16 is provided with a projection 17, which projection 17 extends into the receiving region 18 of the reception groove portion to the extent of approximately one-quarter. The outwardly disposed sidewall 19 of the receiving groove portion 14 is provided with cut-outs 20 at regular spacings corresponding to the spacings of the projections 17, which cut-outs 20 extend from the open edge side of the U-shaped receiving groove portion 14 to the base or floor region 21 of the receiving groove portion 14.

In one such cut-out 20 of the outer sidewall 19, a retaining flap 22 is provided, which is connected to the base or floor region 21 of the receiving groove portion 14 in a pivotably movable manner by way of a film hinge 23. The retaining flap 22 has a wall thickness which is almost the same as the outer wall 19. Also the shape and size of the retaining flap 22 correspond to the greatest possible extent to those of the sidewall 19, so that in a pivoted disposition according to FIG. 4, there is substantial continuity of the retaining flap 22 and the sidewall 19.

On the side of the retaining flap 22 directed towards the bristles 11, the retaining flap 22 has a projection 24 substantially centrally located at its free end region.

Seen in the direction in which the retaining strip 13 extends, the retaining flap 22 has a width at its free end region corresponding to the cut-out 20, the retaining flap 22 being formed to taper towards the film hinge 23. At the free end of the retaining flap 22, as already mentioned, the projection 24 is disposed on the inner side. In this region, the retaining flap 22 has, in each case on its outer edge, noses 25 directed towards the boundary walls of the cut-out 20, which noses engage, in a retaining disposition according to FIG. 4, in corresponding recesses 26 of the outer edge of the outer wall 19 and thus fulfill a gripping function.

On the side located opposite to the projection 24, that is on the outer side of the the sidewall, the retaining flap 22 has a guide means 27 in the form of a sloping surface. This guide means 27 extends from approximately the centre of the height of the retaining flap 22 to the free end of the retaining flap 22, a thickening of the material in the form of a stop strip 28 being formed in the region of the free end. This stop strip 28 continues in the retaining disposition according to FIGS. 4 and 5 in the free end region of the sidewall 19 as strip 29.

Figure 4:
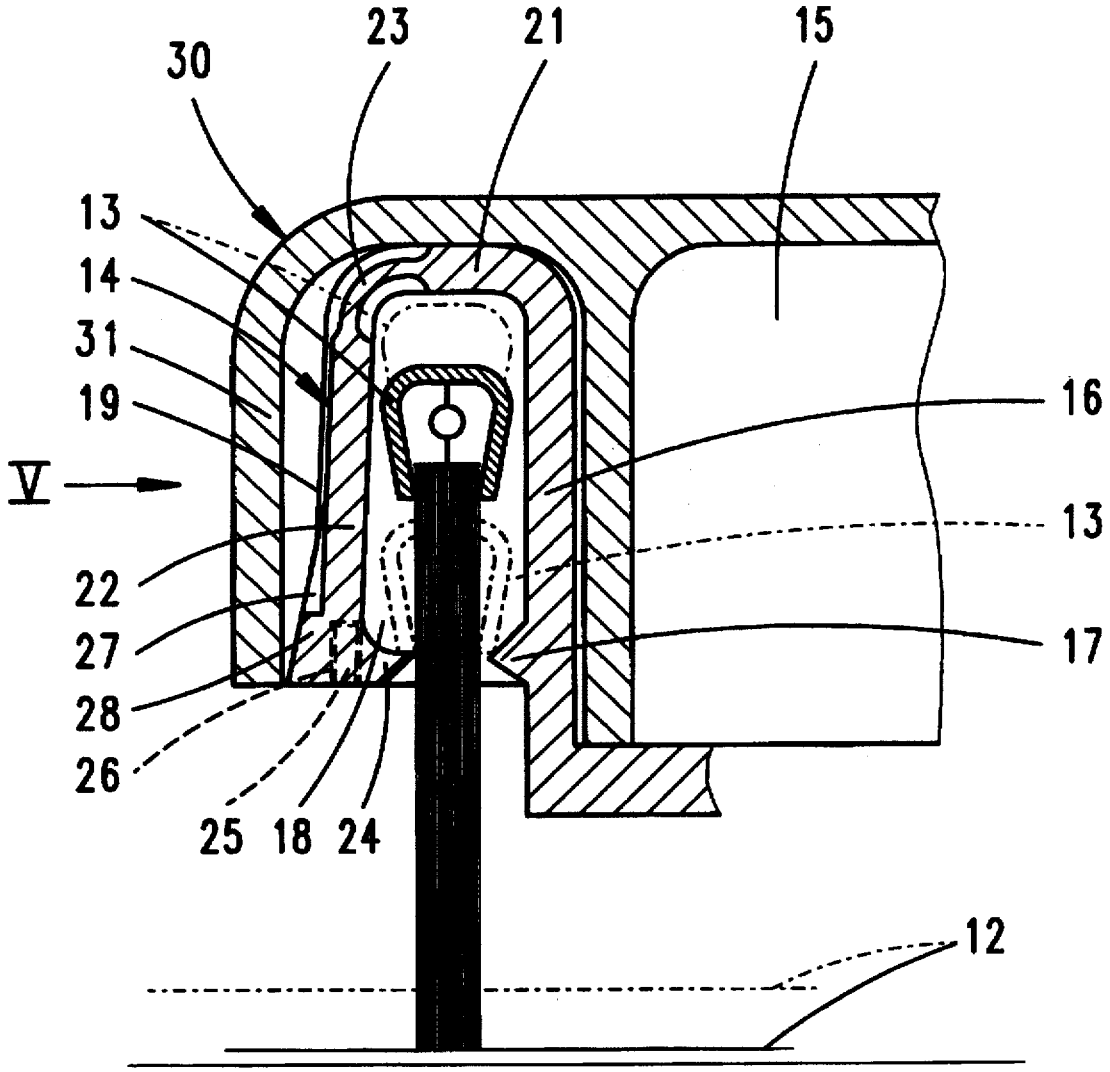
FIG. 4 shows the region of the mounting strip provided with the bristles in an operating disposition of the electrical vacuum cleaning appliance.
Figure 5:
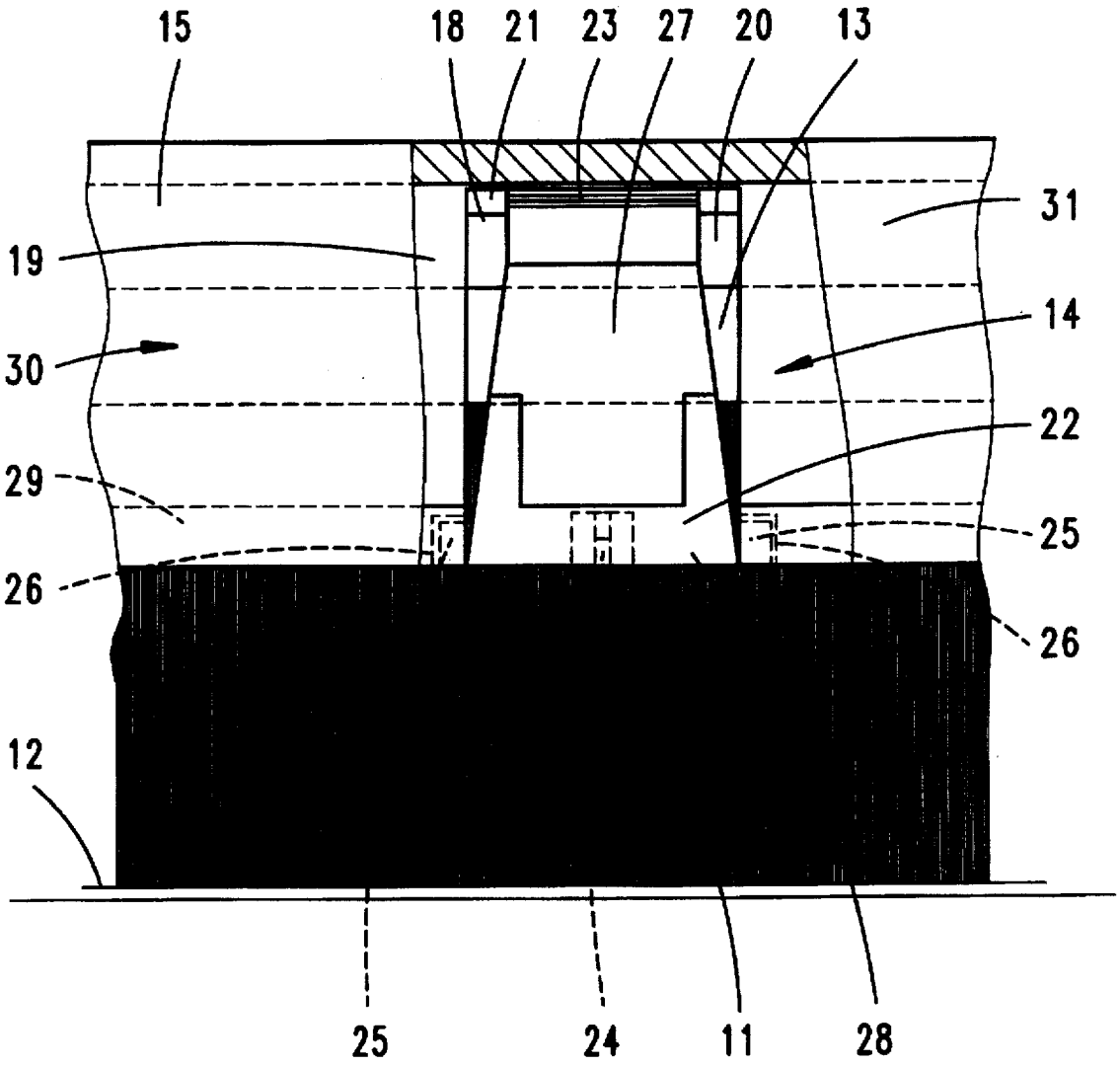
FIG. 5 is a view onto the region of FIG. 4 according to to the arrow V of FIG. 4.

The fitting of the mounting strip 13, provided with the bristles 11, in the suction nozzle 10 is effected in the most simple manner. The mounting strip 13 with the bristles 11 secured therein is introduced into the receiving region 18 of the receiving groove portion 14. There is then effected the insertion of the receiving groove portion 14 into the main frame 15 of the suction nozzle 10 in the region of a U-shaped receiving pocket portion 30. The peripheral edge of the outer sidewall 31 of the receiving pocket portion 30 thus abuts against the retaining flap 22, which, influenced by this, pivots in the direction of the bristles 11. In the course of the insertion of the receiving groove portion 14 into the receiving pocket portion 30, there is thus effected a constrained controlled movement of the projection 24 of the retaining flap 22 into a retaining disposition for the retaining strip 13, according to FIG. 4. In this connection, the retaining flap 22 is moved by means of the guide means 27 in the direction of the bristles 11 until the stop strip 28 abuts against the inner side of the sidewall 31 and the noses 25 of the retaining flap 22 engage in the recesses 26 of the outer sidewall 19 of the receiving groove portion 14. It may also be envisaged that the inner surface of the sidewall 31 of the receiving pocket portion 30 may be provided with a guide means, which may also possibly correspond to the guide means 27 of the retaining flap. FIG. 4 and 5 show the operating disposition of the electrical vacuum cleaner 1 and of the suction nozzle 10, the mounting or holding strip 13 provided with the bristles 11 being held in a vertically displaceable manner in the receiving groove portion 14. In the retaining disposition of the mounting strip 13, the projections 17 and 24 are located opposite one another, so that the mounting strip 13 is supported on the projections 17 and 24 in the event of the electrical vacuum cleaner 1 or the suction nozzle 10 being lifted up (see chain dotted representation in FIG. 4).

Figure 7:
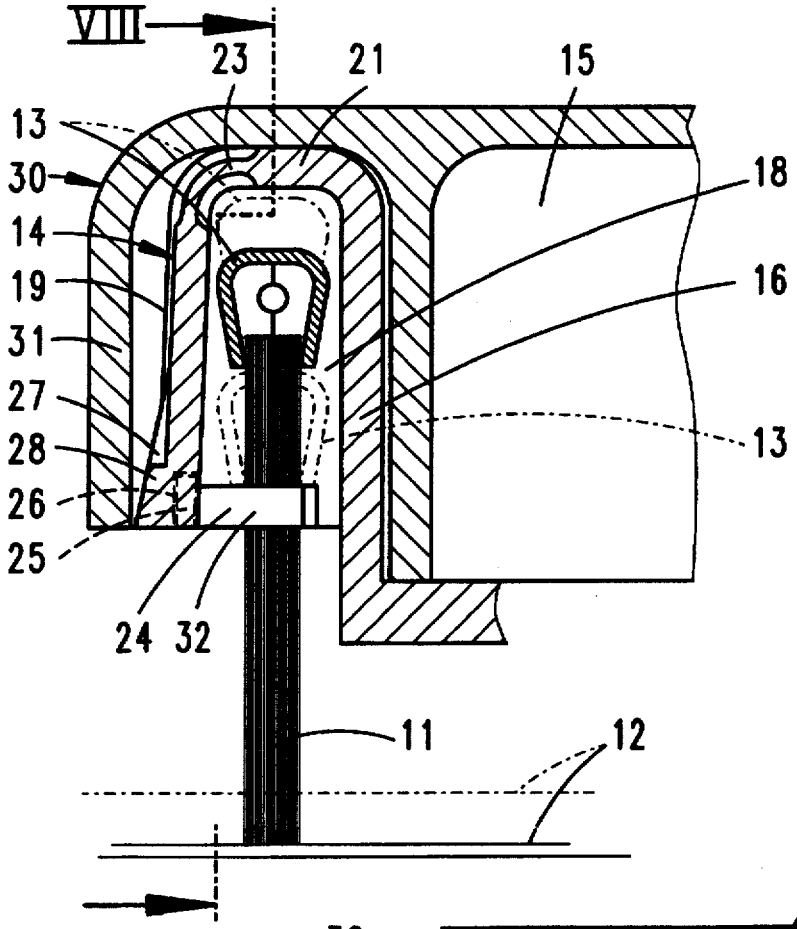
FIG. 7 is a representation corresponding to FIG. 4, but relating to the embodiment according to FIG. 6.
Figure 8:
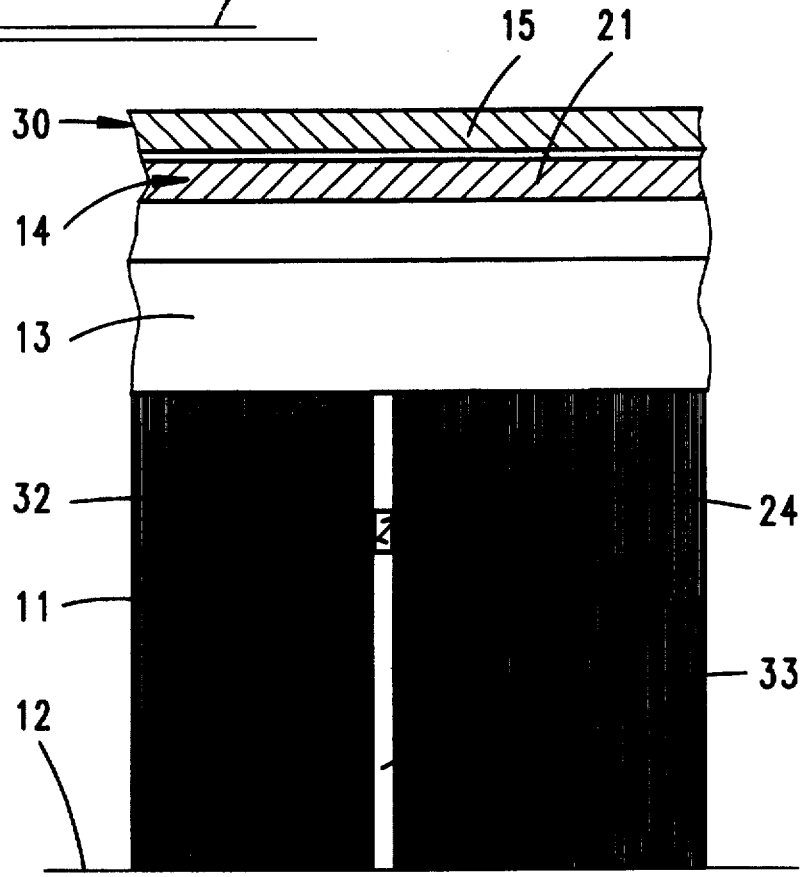
FIG. 8 is a section on the line VIII—VIII of FIG. 7.

FIGS. 6 to 8 show a second embodiment. In contrast to the first embodiment, the inwardly located sidewall 16 of the receiving groove portion 14 has no projection. Rather the retaining disposition for the mounting strip 13 is here realised by the retaining flap 22 having a projection 24 in the form of a retaining finger 32 substantially centrally in the region of its free end. This retaining finger 32 penetrates the region of the bristles 24, for which purpose a gap 33 is formed in this region, in which gap no bristles 11 are provided. The retaining finger 32 penetrates through this gap 33 in the retaining disposition. The mounting strip 13 provided with the bristles 11 is retained in a vertically movable manner in the operating disposition according to FIG. 7, the mounting strip 13 being supported on the retaining finger 32 in the event of the suction nozzle being lifted up (see chain dotted representation in FIG. 7).

Figure 10:
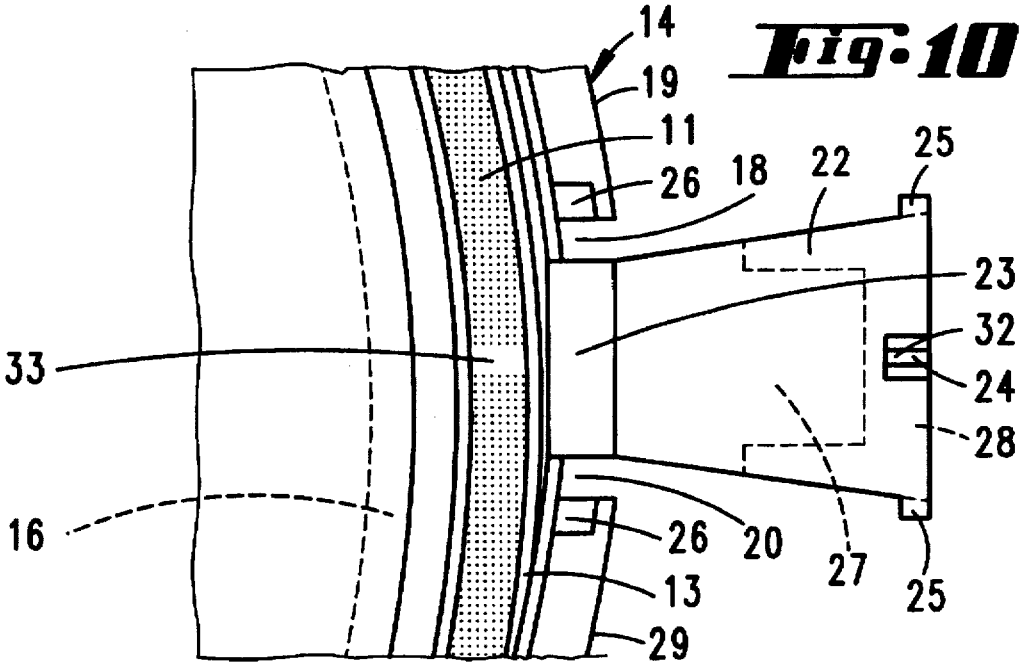
FIG. 10 is a top view of FIG. 9.

FIGS. 9 and 10 show a third embodiment. In addition to the second embodiment, a compression spring 34 is here provided, which is disposed in the receiving groove portion 14 between the mounting strip 13 and the base or bottom region 21 of the receiving groove portion 14. In the operating disposition of the electrical vacuum cleaner 1 or the suction nozzle 10, the mounting strip 13 provided with the bristles 11 is always spring-loaded in the direction of the floor 12 to be serviced. Also in this embodiment, as in those previously described, the receiving groove portion 14 provided with the mounting strip 13 is introduced into the receiving pocket portion 30 in the main frame, the retaining flap 22 being here moved along the guide means 27 in the direction of the retaining disposition of the mounting strip 13. FIG. 10 shows once again in a top view the arrangement of the retaining flap 22 on the receiving groove portion 14.

In all three exemplary embodiments, there results the advantage of a force-free mounting in the suction nozzle 10 of the mounting strip 13 provided with the bristles 11. After insertion of the mounting strip 13 provided with the bristles 11 in the separate receiving groove portion 14, this component group is inserted into the main frame 15 of the suction nozzle 10 in the region of the receiving pocket portion 30, the projections 24 or the retaining finger 32 disposed on the retaining flap 22 being moved in a constrained and controlled manner into a retaining disposition of the mounting strip 13. A demounting may also be effected without damage, according to this construction, in order to change for example used bristles 11.

We claim:

1. Floor care appliance having downwardly directed bristles arranged around an outer edge of the appliance, the bristles being secured in a mounting strip and the mounting strip being held in a positive manner enclosed in a receiving groove portion in part of the appliance which is downwardly open, which appliance part has sidewalls and inwardly extending projections disposed on the sidewalls; and wherein the projections of one of the sidewalls are displaceable into a release disposition for the mounting strip; and the appliance part includes a retaining flap, and the projections of one sidewall are formed on the retaining flap which is hinged onto the appliance part.

2. Floor care appliance according to claim 1, wherein the retaining flap is disposed on the appliance part having the receiving groove portion by means of a film hinge.

3. Floor care appliance according to claim 1, wherein the retaining flap forms a portion of the one sidewall of the appliance part having the receiving groove portion.

4. Floor care appliance according to claim 1, wherein the appliance part having the receiving groove portion is disposed in a receiving pocket of a main frame.

5. Floor care appliance according to claim 4, wherein the appliance part having the receiving groove portion has a configuration which cooperates with a configuration of the receiving pocket portion to provide, in the course of an insertion of the appliance part having the receiving groove portion into the receiving pocket portion, a constrained controlled movement of the retaining flap of the one sidewall 11 into a retaining disposition for the mounting strip.

6. Floor care appliance according to claim 5, wherein guide means are formed on an outer surface of the retaining flap to provide the constrained controlled movement of the retaining flap into the retaining disposition.

7. Floor care appliance according to claim 5, wherein guide means are formed on an inner surface of the receiving pocket portion for the constrained controlled movement of the retaining flap into the retaining disposition.

8. Floor care appliance according to claim 1, wherein the retaining flap is lockable in its retaining disposition.

* * * * *